US009752379B2

(12) United States Patent
Aykas

(10) Patent No.: US 9,752,379 B2
(45) Date of Patent: Sep. 5, 2017

(54) CORNER FITTING WITH ADJUSTABLE RESTRAINING AREA

(71) Applicant: DORMA Deutschland GmbH, Ennepetal (DE)

(72) Inventor: Kenan Aykas, Ennepetal (DE)

(73) Assignee: DORMA DEUTSCHLAND GMBH, Ennepetal (DE)

( * ) Notice: Subject to any disclaimer, the term of this patent is extended or adjusted under 35 U.S.C. 154(b) by 0 days.

(21) Appl. No.: 14/946,131

(22) Filed: Nov. 19, 2015

(65) Prior Publication Data

US 2016/0177619 A1 Jun. 23, 2016

(30) Foreign Application Priority Data

Dec. 4, 2014 (EP) ..... 14196249

(51) Int. Cl.
*E05D 5/02* (2006.01)
*E06B 3/88* (2006.01)
(Continued)

(52) U.S. Cl.
CPC ..... *E06B 3/88* (2013.01); *E05D 1/00* (2013.01); *E05D 5/0246* (2013.01); *E05D 7/081* (2013.01);
(Continued)

(58) Field of Classification Search
CPC . E05D 5/0246; E05D 5/02; E05D 2005/0261; E05D 2005/0269; E05D 2005/0253; E05D 7/081; E05D 7/08; E05D 7/082; E05D 7/083; E05D 7/084; E05D 7/04; E05D 7/043; E05Y 2900/114; E05Y 2900/132; E05Y 2600/502; E05Y 2600/60; E05Y 2600/12; E05Y 2600/634; E05Y 2800/672; E05Y 2800/178; E05Y 2800/72;
(Continued)

(56) References Cited

U.S. PATENT DOCUMENTS 2,154,716 A * 4/1939 Anderson ..... E05D 7/04 16/247
2,191,900 A * 2/1940 Pariot ..... E06B 3/02 16/253
(Continued)

FOREIGN PATENT DOCUMENTS

DE 2541026 B1 1/1977
DE 8536840 U1 2/1990
(Continued)

*Primary Examiner* — Chuck Mah
(74) *Attorney, Agent, or Firm* — Cantor Colburn LLP

(57) ABSTRACT

A corner fitting for a door element, in particular for a glass door element, includes first and second fitting elements, which each include, at least sectionwise, a locating portion, which includes an intermediate layer able to contact the door element. The fitting elements delimit the restraining area, wherein a holding element is in operative connection with a connecting element, which serves for supporting the door element on a center of rotation and/or an axis.
At least one exchangeable rigid distancing element is disposed between the fitting elements outside the locating portions. The distancing element forms a counter-bearing to the locating portions and the door element which can be restrained in the restraining area.

14 Claims, 5 Drawing Sheets

(51) Int. Cl.

| | |
|---|---|
| ***E05D 7/081*** | (2006.01) |
| ***E05D 1/00*** | (2006.01) |
| ***E06B 3/02*** | (2006.01) |
| ***E06B 3/36*** | (2006.01) |
| ***E06B 3/968*** | (2006.01) |
| *E05D 15/54* | (2006.01) |
| *E06B 3/70* | (2006.01) |

(52) U.S. Cl.
CPC ..... *E06B 3/02* (2013.01); *E06B 3/36* (2013.01); *E06B 3/968* (2013.01); *E05D 15/54* (2013.01); *E05Y 2201/638* (2013.01); *E05Y 2600/12* (2013.01); *E05Y 2600/634* (2013.01); *E05Y 2800/178* (2013.01); *E05Y 2800/672* (2013.01); *E05Y 2800/72* (2013.01); *E05Y 2900/132* (2013.01); *E06B 2003/7049* (2013.01)

(58) Field of Classification Search
CPC ..... E05F 11/385; E05F 11/0054; E06B 3/54; E06B 3/02; E06B 3/36; E06B 3/968; A47K 3/362; A47K 2003/367; A47F 3/12; A47F 3/125; Y10T 16/534; Y10T 16/5326; Y10T 16/554; Y10T 16/5323; Y10T 16/533; Y10T 16/5335; Y10T 16/5327
See application file for complete search history.

(56) References Cited

U.S. PATENT DOCUMENTS 3,555,733 A * 1/1971 Horgan, Jr. ..... E05D 5/0246 16/245
3,796,405 A * 3/1974 Rystad ..... E05D 15/0634 248/316.7
3,828,394 A * 8/1974 Horgan, Jr. ..... E05D 5/0246 16/241
4,513,474 A * 4/1985 Watabe ..... E05D 5/046 16/243
4,535,503 A * 8/1985 Narita ..... E05D 5/0246 16/109
4,689,853 A * 9/1987 Marinoni ..... E05D 5/0246 16/382
4,848,032 A * 7/1989 Ballor ..... B60J 1/17 49/350
4,977,642 A * 12/1990 Marinoni ..... E05D 5/0246 16/257
5,203,115 A * 4/1993 Marinoni ..... E05D 5/0246 16/236
6,381,909 B1 * 5/2002 Liao ..... E05D 5/0246 49/388
7,673,373 B2 * 3/2010 Chang ..... E05D 5/0246 16/250
2003/0213103 A1 * 11/2003 Cameron ..... A47K 3/36 16/382
2004/0221950 A1 * 11/2004 Mizusawa ..... E05F 11/385 156/272.4
2006/0277716 A1 * 12/2006 Sprague ..... A47K 3/36 16/252
2007/0107351 A1 * 5/2007 Garrett ..... E05D 5/0246 52/474
2011/0214254 A1 * 9/2011 Fellman ..... E05D 5/0215 16/252
2015/0043965 A1 * 2/2015 Mao-Cheia ..... E05D 5/0246 403/338

FOREIGN PATENT DOCUMENTS

| | | | |
|---|---|---|---|
| DE | 102009022803 | A1 | 12/2010 |
| DE | 102012022674 | A1 | 5/2014 |
| EP | 0362044 | A1 | 4/1990 |
| EP | 0940542 | A2 | 9/1999 |
| FR | 2122031 | A5 | 8/1972 |

* cited by examiner

CORNER FITTING WITH ADJUSTABLE RESTRAINING AREA

TECHNICAL FIELD

The present disclosure relates to a corner fitting for a door element, in particular to a glass door element.

BACKGROUND

Corner fittings are known from the state-of-the-art, which allow for disposing door elements with different thicknesses, in particular glass door elements with different glass thicknesses on a center of rotation and/or an axis. The glass doors are for example double-action glass doors, which are disposed by means of the known corner fittings for example on a BTS-axis next to a sidepanel. Mostly, the structure of the prior art corner fittings comprises two fitting elements, which each include a locating portion for the door element, wherein an intermediate layer, which at least in sections, corresponds to the contour of the locating portions and is surrounded by the locating portion, is inserted between the locating portions and the door element. Outside the locating portions, the fitting elements form a free space within a cutout of the door element, which space is utilized for accommodating for example an axis between the fitting elements. With the intention to be able restrain door elements in particular glass door elements of different thicknesses between the fitting elements, the prior art corner fittings are dimensioned such that in their delivery condition, i.e. in an initial position, they are able to accommodate a door element having a predetermined glass thickness, for example a glass thickness of 15 mm. In the event, another glass door element having a glass thickness of 10 mm were to be restrained in the corner fitting adjusted to a glass door element of 15 mm, in the prior art corner fitting, the intermediate layer is reinforced for compensating for the difference between the glass thicknesses. Therefore, in the present example, the intermediate layers are increased on both sides of the glass door element by 2.5 mm. In this case, by increasing the intermediate layers, the fitting elements abutting on both sides against the door element, move away from the door element by respectively 2.5 mm. Together with the fitting elements, also the cover or covering elements, which surround the fitting elements, move away from the door element on both sides by respectively 2.5 mm. Accordingly, a gap of 2.5 mm is automatically created on both sides of the door element, namely between the surfaces of the door element and the cover or covering element, which covers the fitting elements on both sides. To prevent said gap creation, the delivered cover or covering element, which is configured with the corner fitting adapted to a glass thickness of a door element of 15 mm, would have to be exchanged for a cover or covering element, which is deeper configured for both sides of the door element. In an extreme case, namely with a corner fitting adapted to a glass door element of 15 mm, which is intended to be converted for receiving a glass door element of for example 7 mm, the intermediate layers would have to compensate for a difference between 15 mm and 7 mm. This means, the intermediate layer on both sides of the door element needs to be increased by 4 mm. Thereby, the construction depth of the prior art corner fittings on both sides of the door element is larger by 4 mm. In addition, the clamping effect of the door element between the fitting elements and thereby the durability of the prior art corner fitting are reduced on account of the ever increasing intermediate layers.

Therefore, the disclosure overcomes the above-described disadvantages of the state-of-the-art at least partially. In particular, the disclosure provides a corner fitting, which allows for enhanced adjustability, namely the adjustment to door elements having different door leaf thicknesses, in particular having different glass thicknesses, and in which the distance of the fitting elements to the restrained door element is constant regardless of the door leaf thickness.

In this case, features and details, described in conjunction with the inventive corner fitting are obviously also valid in conjunction with the inventive method, and respectively vice versa, such that mutual reference is made, respectively can be made with respect to the disclosure of individual aspects of the disclosure.

SUMMARY

The inventive corner fitting for a door element, in particular for a glass door element including a first fitting element and a second fitting element, which each at least sectionwise include a locating portion, which comprises an intermediate layer able to contact the door element, and the fitting elements delimit a restraining area, wherein a holding element is in operative connection with a connecting element, which serves for supporting the door element on a center of rotation and/or an axis, includes the technical teaching that at least one rigid distancing element is disposed between the fitting elements outside the locating portions, wherein the distancing element forms a counterbearing to the locating portions and the door element, which can be restrained in the restraining area.

This solution offers the advantage that the distancing element between the fitting elements serves as a counterbearing, i.e. within the corner fitting, and thus the distance between the fitting elements and the door element, namely in particular in the area of the locating portions, which respectively comprise the intermediate layer, which the door element contacts, in relation to the door element remains always constant. According to the disclosure, this means, the intermediate layer always remains in the contact position with the door element, independently of the thickness of the door element restrained between the fitting elements, because the distancing element can be exchanged depending on the door leaf thickness, in particular the glass thickness of the door element, and thereby replaced by a distancing element adapted to the door leaf or the glass thickness of the door element. In this case, the dimension of the distancing element and the door leaf, respectively the glass thickness of the door element indicates the distance of the fitting elements in relation to each other. However, adapting the inventive corner fitting for example to different glass door elements having different glass thicknesses does not change the distance of the fitting elements in relation to the door element. This is advantageous in that a frame or cover surrounding the respective fitting elements is always abutting against the glass door element independently of the thickness thereof, because the intermediate layer, which is disposed in the usual way between the fitting elements and the glass door element always remains constant. Insofar, utilizing the distancing element will advantageously prevent a gap creation between the fitting elements and the door element.

This means automatically that the construction depth of the inventive corner fitting on both sides of the door element is always the same independently of the door leaf, respectively the glass or material thickness of the door element restrained in the inventive corner fitting.

As the exchangeable rigid distancing element allows for variably adjusting the inventive corner fitting to the door leaf, respectively glass thickness of the door element clamped by means of the corner fitting should the material thickness change, in advantageous manner the thickness of the intermediate layer, which is disposed between the fitting elements and the door element and is surrounded by the locating portions, can always remain constant, whereby according to the disclosure an exchange of the intermediate layers independently of the glass thickness of the restrained door element becomes obsolete. Advantageously, thereby independently of the door elements having different thicknesses restrained in the inventive corner fitting, an always consistent stability of the corner fitting with consistent material thickness of the intermediate layer can be guaranteed. In addition with the always consistent intermediate layer on both sides of the door element and with a simultaneous increase of the variability, the system costs thereof are reduced.

Advantageously, the fitting elements have a mount provided outside the locating portions and at which mount the distancing element is disposed. Advantageously, the distancing element is non-positively and/or positively, in particular positively retained via at least one of its ends in a mount configured at the fitting element. With its other end, which is not retained in the mount, the distancing element preferably props up against the opposite fitting element. By shifting the adjustability to areas outside the locating portions, which respectively comprise at least one intermediate layer, advantageously, the inventive corner fitting, while keeping the intermediate layer and while keeping the restraining area, which is delimited by the fitting elements, can be adjusted by exchanging the distancing elements, which are inserted into the mounts disposed outside the locating portions.

In order to be able to accommodate the distancing element in this case, the mount, which can be configured in one or in both fitting elements or can be disposed in them, includes a reception into which the distancing element extends. Preferably, the reception is an aperture, for example a bore, a pocket-bore or a milling, the contour thereof, i.e. the shape thereof being preferably adapted to the exterior contour of the distancing element. If for example the distancing element is configured as a polygon element, for example in the shape of a polygon bar, the bore, respectively milling is advantageously configured as a polygon hole or a polygon milling. Obviously, the distancing element may be configured in the shape of a round bar, wherein then the bore, respectively the milling is advantageously adapted to the shape of the round bar. In this case, the configuration of the distancing element as a round stick or as a polygon element should not be understood as a limitation, rather all contours of the distancing element are conceivable, the external contour thereof being representable in the bore, respectively in the milling in the fitting element, so the distancing element can be positively accommodated.

Advantageously, the fitting elements are embodied with a lower recess, in which the connecting element is displaceable, wherein in particular a bottom area forms as a free space between the fitting elements, and the bottom area, in which the distancing element and/or the mount is/are disposed, is located approximately on the same height as the lower recess. In this case, the lower recess is preferably formed in both fitting elements and extends over the distance of the fitting elements from the one to the other fitting element. Advantageously, the lower recess serves for displacing the connecting element together with the holding element at least sectionwise in longitudinal extension of the fitting elements. For guaranteeing a displacement of the connecting element over the entire length of the lower recess, the contour of the lower recess is adapted to the exterior contour of the connecting element. In case the exterior contour of the connecting element presents for example rounded corners, the contour of the recess has rounded corners as well, which correspond to the shape and the radius of the rounded corners of the exterior contour of the connecting element. In addition and advantageously, the rounded corners of the contour of the recess serve for preventing jamming of the connecting element in the border areas of the lower recess. Therefore, the lower recess guarantees that the connecting element, without getting in contact with the glass door element, can be displaced in the cutout formed by means of the glass door element preferably in longitudinal extension of the fitting elements in the free space formed in the bottom area. With the intention to dispose the distancing element without having contact to the glass door element between the fitting elements, it is advantageously suggested to dispose the distancing element or the mount, which accommodates the distancing element, almost at the same height as the lower recess in the free space preferably formed between the fitting elements in the bottom area. Advantageously in this case, the mount is disposed in direct adjaceny to the lower recess at or at least in one of the fitting elements.

With the intention to not only configure a counter-bearing to the locating portions and to the door element restrained in the restraining area punctually via only one distancing element, it is advantageous to dispose at least one second distancing element at least at one fitting element, which is almost parallel to the first distancing element on the same height. Thus, for example with a glass cutout "universal", a first distancing element can be disposed between the fitting elements at the exterior border of the corner fitting. A second distancing element could then be disposed on the same height approximately parallel to the first distancing element at the opposite exterior border between the fitting elements. The two distancing elements together will then form a counter-bearing to the locating portions and to the door element restrained in the restraining area, whereby altogether the stability of the inventive corner fitting is increased.

Advantageously, the distancing elements are disposed on both sides adjoining the lower recess in the free space formed between the fitting elements in the bottom area. In this case, the distancing elements may be disposed only at one fitting element or at alternating sides at both fitting elements in mounts.

Obviously, it is also conceivable that the inventive corner fitting is structurally configured for a glass door element having a glass thickness of 8 mm, such that the fitting based on said structural configuration is fully functional without inserting a distancing element, wherein outside the locating portions, the fitting elements are abutting against each other at least sectionwise. For adapting the mentioned corner fitting to a door element having a thicker glass thickness, for example a glass thickness of 15 mm, distancing elements will be disposed between the fitting elements, which need to be adapted to the size, i.e. the thickness of the 15 mm thick glass door element, namely the dimension of the difference between the 8 mm thick glass door element and the 15 mm thick glass door element. In the described case, the distancing element would have to extend between the fitting elements over 7 mm, namely for bridging a distance of 7 mm between the fitting elements. In other words, this means that the distancing element, respectively the distancing elements is/are adapted to the spacing of the fitting elements, which is given by the thickness of the inserted door element. As a means to simplify adapting the inventive corner fitting to the glass thicknesses of the door element to be restrained, the glass thicknesses may be marked on the distancing elements. If for example the inventive corner fitting in the delivery condition is intended for door elements having a door leaf thickness of 8 mm, an assortment of distancing elements can be provided in a set with the corner fitting, which will allow for the conversion, respectively the adaptation of the corner fitting to door elements for example with 15 mm, 18 mm and 22 mm. Advantageously in this case, the distancing elements will be provided in pairs, wherein preferably the door leaf thickness, namely 15 mm, 18 mm or 22 mm will be indicated on the distancing elements or on a packaging.

In advantageous manner, the mount forms a common structural component with a fitting element, wherein advantageously the structural component is configured integrally and/or monolithic. In this case, for example a structural component manufactured in an injection molding process from one or more different components is understood as a monolithic structural component. A structural component manufactured from a material, which for example is carved out from the material by machining a material, for example a metal block, can be understood as an integral structural component. Preferably, a common structural component is also understood in that the mount and the fitting element are configured as individual parts, which are provided as a common structural component in a pre-mounted condition.

As the inventive corner fitting is preferably configured for supporting a door element on an axis of rotation respectively a center of rotation advantageously, the corner fitting comprises a holding element, which is in operative connection with a connecting element, by means of which the door element restrained in the restraining area between the fitting elements can be aligned on the center of rotation and/or the axis of rotation. Preferably in this case, via attaching elements, the connecting element is connected to a holding element, which allows for the infinitely variable adjustment of the door element on non-standard centers of rotation. Said structural components connected to each other preferably form an attaching mechanism, which is advantageously incorporated at both structural components, namely at the holding element and at the connecting element, and which mechanism can be transferred between a released condition and a fixing condition, wherein the holding element is displaceable at the fitting elements in the released condition, and in the fixing condition, it is at least non-positively and/or positively attached to at least one fitting element. Accordingly, on the one hand, the attaching mechanism formed at the holding element and at the connecting element advantageously serves for infinitely variably adjusting the corner fitting on a center of rotation and/or an axis, i.e. for infinitely variably displacing the holding element and the connecting element connected to the holding element in relation to the fitting elements and in particular in relation to the longitudinal extension of the fitting elements. Moreover, the attaching mechanism serves for fixing the corner fitting in the adjusted position, namely for fixing the holding element, at least at one of the fitting elements via the attaching mechanism at least non-positively and/or positively. Accordingly, for adjusting the connecting element on the center of rotation and/or the axis, the holding element can be guided to be freely displaceable with the connecting element, i.e. according to the disclosure, it can be guided to be infinitely variably displaceable with regard to the longitudinal extension of the fitting elements. Once the position of the connecting element is adjusted to the center of rotation and/or the axis, immobilizing the holding element and thereby also at least indirectly of the connecting element is realized via the attaching mechanism by means of a non-positive clamping connection with at least one of the fitting elements via the holding element, which is preferably configured as a clamping plate.

For establishing an operative connection between the holding element and the connecting element, i.e. for forming the attaching mechanism, the holding element and the connecting element are particularly and advantageously non-positively and/or positively connected to each other via at least one attaching element. The attaching element between the holding element and the connecting element may be for example a screw, such as e.g. a headless screw, which connects the holding element and the connecting element to each other. Particularly advantageously, at least two attaching elements are provided, which connect the holding element to the connecting element. For adjusting the attaching mechanism, in particular for transferring the attaching mechanism from the released condition into the fixing condition and vice versa, preferably the attaching element, respectively the attaching elements is/are disposed at the connecting element to be accessible for the user from outside. As the connecting element is in operative connection with the holding element, which is guided between the fitting elements, and is therefore difficult to access, advantageously via the attaching elements, which can be manipulated from outside at the connecting element, the attaching mechanism and in particular the holding element can be transferred from its fixing condition, i.e. from the clamping with the free space configured as a recess, into the released condition, i.e. for establishing the infinitely variable displaceability in longitudinal extension of the fitting elements, and vice versa.

The non-positive and/or positive connection between the holding element and the connecting element, i.e. the transfer of the attaching mechanism from the released condition into the fixing condition, serves in addition in an advantageous manner for immobilizing the holding element at the attaching element. Preferably, for this purpose, the attaching element includes a free space as a guide, for example in the shape of a recess, a groove or a rail, at which, respectively in which the holding element is guided, respectively supported to be movable. Advantageously, in this case, the free space in the fitting element is configured such that the holding element is displaceable, respectively guidable in longitudinal extension of the fitting element. As the fitting element, respectively the fitting elements of the corner fitting are oriented parallel to the front and/or rear surfaces of the door element, the displacement of the holding element in longitudinal extension of the fitting element causes a displacement of the door element with the fitting element in the opposite direction to the displacement of the holding element in the longitudinal extension of the fitting element. Thereby, it will possible to align the door element, for example within a door casing to the long sides of the casing and to the center of rotation and/or the axis. If said displaceability of the door element in relation to the center of rotation was not given, in case of an incorrect position of the center of rotation and/or the axis, for example a double-action door, set on a firm center of rotation and/or a firm axis, would with one of its edges unintentionally contact a wall or another structural glass element. In the event an abutment of the double-action door is configured at least partially at another glass door element or at the wall, in case of an incorrect adjustment of the corner fitting or in case of an incorrect position of the center of rotation and/or the axis, the door element would pivot past the abutment.

Advantageously, the holding element is configured as an L-profile with a head part and a connecting part, preferably in the shape of two surfaces essentially orthogonally to each other, i.e. that the head part is vertically aligned to the connecting element, wherein the head part is supported in a free space configured as a groove, as a slot or as a recess in one of the fitting elements to be movable in the released condition of the attaching mechanism, and in the fixing condition of the attaching mechanism, acts in a clamping manner in the recess. In the event both respective fitting elements each include a free space configured as a groove, as a slot or as a recess, the head part of the holding element, respectively the holding element is advantageously configured as a T-profile, for supporting the holding element to be movable in both recesses of the fitting elements, respectively for clamping it. By transferring the attaching mechanism from its released condition into the fixing condition, the holding element configured as a T-profile on both sides, i.e. in both free spaces configured as a groove, a slot or a recess of the fitting elements, offers at least sectionwise a resting portion, which serves for the non-positive and/or positive connection between the holding element and the fitting elements. In this case, preferably in the fixing condition of the attaching mechanism, the head part of the holding element acts in a clamping manner in both grooves, slots or recesses. In contrast to the holding element configured as an L-profile, the holding element configured as a T-profile clamps equally on both sides of the corner fitting, namely at both fitting elements. Thereby, it is possible to achieve a more stable non-positive and/or positive connection, i.e. an improved clamping action between the holding element and the fitting elements, with the holding element configured as a T-profile compared to the holding element configured as an L-profile. As already described for the holding element configured as an L-profile, in the holding element configured as a T-profile via the attaching elements, the connecting element is connected to the holding element via a connecting part.

In preferred manner, the free space is configured in at least one of the fitting elements as a recess. In this case, the recess extends preferably in longitudinal extension of the fitting element and in a particular advantageous manner respectively in longitudinal extension of both fitting elements, wherein the recesses in the two fitting elements are preferably configured on the same height and parallel to each other. The free space in the fitting elements, referred to as recess is particularly preferred configured as a groove or a slot, and advantageously serves for guiding the holding element essentially parallel to the fitting elements and in relation to the longitudinal extension thereof. Advantageously, for this purpose the holding element includes the head part, which serves for supporting the holding element, at least in the released condition of the attaching mechanism, to be movable in the free space of one fitting element or of both fitting elements.

In advantageous manner, the attaching mechanism is configured such that in the released condition a static friction is effective between the holding element and the recess, which is considerably lower than the static friction, which is effective in the fixing condition between the holding element and the recess. Preferably, the attaching element and even more preferred two attaching elements serve for increasing the static friction from the released condition into the fixing condition of the attaching mechanism, via which attaching elements the static friction is adjustable between the recess and the holding element. If for example the attaching element configured as a screw is screwed into the holding element via the connecting element, preferably the static friction is increased between the holding element and the recess. When unscrewing the attaching element, the static friction between the holding element and the recess is advantageously lowered and the attaching mechanism is transferred into the released condition.

Preferably, the static friction between the holding element and the recess is increased until the holding element is fixed at least at one of the fitting elements via the attaching mechanism. In this case, advantageously in the fixing condition, a clamping is effective between the holding element and the recess, wherein the clamping prevents a movement of the holding element in relation to the fitting element. With the clamping and the fixed positioning of the holding element in the fixing condition of the attaching mechanism, advantageously also the connecting element in operative connection with the holding element is fixed in its position in relation to the fitting elements.

Based on a compact embodiment of the inventive corner fitting requiring only little constructional space, preferably, the attaching mechanism is configured in that, during the transfer from the fixing condition into the released condition and vice versa, the holding element performs a stroke movement within the free space. As the attaching mechanism is advantageously incorporated in the holding element and in the connecting element, no additional structural components are required for forming the attaching mechanism. In this case, advantageously, in addition to serving for infinitely variably guiding the holding element in longitudinal extension to the fitting elements, the free space, configured as a recess in the fitting elements, also serves for accommodating the holding element in an at least clamping manner and namely advantageously at any position in the recess.

Advantageously, the connecting part and the head part of the holding element are configured as a common, monolithic and/or integral structural component. In this case, for example a structural component manufactured in an injection molding process from one or more different components is understood as a monolithic structural component. A structural component manufactured from a material, which component for example is carved out from the material block by milling, for example a material block, for example a metal block, can be understood as an integral structural component. Preferably, a common structural component is understood in that the head part and the connecting part are configured as individual parts, which are provided as a common structural component, namely as the holding element in a pre-mounted condition.

As the maximum spacing of the fitting elements, respectively the maximum dimension of the distancing elements is limited by the resting portion of the holding element, the resting portion of the holding element is at least dimensioned such that the dimension allows for a spacing of the fitting elements from an initial position plus/minus 10 mm, preferred plus/minus 15 mm and particularly preferred plus/minus 20 mm. This means that for example resting portions of the holding element in T-profile shape, which are guided on both sides in the recesses of the fitting elements, can be moved out of the recesses of the fitting elements by respectively at least 5 mm. If however, it is desired to additionally compensate with the inventive corner fitting for a plane offset between the door element and an adjoining sidepanel, it is advantageous, if the resting portions of the holding element, which are guided on both sides in the recesses, are dimensioned such that they can be moved on both sides, i.e. respectively out of the one or the other fitting element, respectively out of the recesses of the fitting element by at least 10 mm, respectively can be moved into the recesses of the opposite fitting element.

Obviously, it is also conceivable that the distancing element, respectively the distancing elements are configured with at least one fitting element as a common, monolithic and/or integral structural component. For being able to adapt such a configured corner fitting to door elements of various thicknesses, the fitting elements, which are formed as a monolithic and/or integral structural component with the distancing elements, would have to be exchanged as an entire component. In the event a fitting element with an already pre-mounted distancing element and configured as a common structural component were to adapt to a different door leaf thickness, the already pre-mounted distancing element or the distancing elements would have to be replaced by distancing elements from the provided set.

The principle of variability of the restraining area should be understood according to the idea of the present disclosure to be applicable to corner fittings and in particular to all door fittings no matter what type and shape. In particular locks and lock strike boxes, which need to be clamped to differently thick door leaves, in particular to glass door having different glass thicknesses, respectively dimensions are understood as door fittings. In this case, the features mentioned in the description, as well as the features of the corner fitting, which are shown and described in the Figures, can be applied individually or in any combination to the fittings.

In the present application the following terms are understood as follows:

A distancing element and preferably at least two or more distancing elements are understood as "distancing element". The one distancing element respectively the distancing elements may be non-positively and/or positively, and in particular positively accommodated at the fitting elements on alternating sides and prop up on the other fitting element. Obviously, the distancing elements could be accommodated just in mounts at only one fitting element and would then prop up on the opposite fitting element.

A structural component, which extends to a pre-defined measure between the fitting elements and wherein corresponding to the material thickness of a door element or for example the material thickness of elements such as a sidepanel or an overpanel of an all-glass door installation, which according to the disclosure are restrained in the corner fitting, is understood as a "rigid distancing element", which can be selected from an assortment of differently sized distancing elements.

A structural component, which is movable essentially parallel to the fitting elements, i.e. displaceable and advantageously also rotatable, is understood as the "holding element" and which serves for displacing the connecting element, which is operatively connected to the holding element, parallel to the fitting elements and for aligning it with a door element restrained in a restraining area about a center of rotation and/or an axis. In this case, the holding element may be configured as a single-surface or multi-surface body. Obviously, the holding element may as well be configured of one or more struts connected to each other or otherwise, such as of an angled part. The space available between the fitting elements and formed by the distance of the fitting elements to each other is the only limiting factor for the type and construction form of the holding element.

A structural component accommodating the center of rotation and/or the axis is understood as the "connecting element". For increasing the variability of the connecting element, said reception may have different sizes, respectively may be adaptable to receptions having different sizes, for example by means of adapter inserts. The connecting element may thus be a separate structural component, which is in operative connection with the holding element via attaching elements, or it may as well be embodied with the holding element as a common monolithic and/or integral structural component.

The inventive corner fitting is not only intended for adaptation of the restraining area to door elements having different thicknesses, in particular with different glass thicknesses, but should also be configured such as to be infinitely variably adjustable to different centers of rotation or centers of axis, i.e. different pivot center dimensions ranging approximately between 45 mm to 80 mm. In addition the inventive corner fitting is intended to adjust a plane offset between the door element and for example a sidepanel. The inventive corner fitting should also be able to compensate for an angle offset of the door element at a sidepanel or to a door casing, i.e. provide adjustment.

A free space configured in the shape of grooves, small channels, furrows, shoulders, rails, protrusions, slots and/or for example roller belts, which allows for a displaceable, i.e. mobile support of the holding element, may be understood as the "free space, which is configured as a recess in at least one fitting element". Obviously, latching means may be configured along the free space, which allow for the holding element to latch in and thus for a pre-adjustment of the door element to given dimensions of points of rotation and/or dimensions of axes. However, it might be that just latching and/or stop points are configured for standardized centers of rotation and/or axes. In this case, an infinitely variable displaceability of the holding element in the free space is guaranteed advantageously between two latching means, respectively between two latching and/or stop points, whereby a fine-tuning of the corner fitting is possible on non-standardized centers of rotation.

The inventive method for adjusting a corner fitting to a door element, in particular to a glass door element, for accommodating different material thicknesses of the door element in the corner fitting, including a first fitting element and a second fitting element, which each at least sectionwise include a locating portions, which comprises an intermediate layer able to contact the door element, and the fitting elements delimit the restraining area, wherein a holding element is in operative connection with a connecting element, which serves for supporting the door element on a center of rotation and/or an axis, at least one exchangeable rigid distancing element being disposed between the fitting elements outside the locating portions, wherein the distancing element forms a counter-bearing to the locating portions and the door element, which can be restrained in the restraining area, includes the following steps:

1) dismounting the fitting elements,
2) removing the distancing elements from the mount,
3) inserting a new distancing element into the mount,
4) mounting the fitting elements.

Advantageously, the method is facilitated with the use of the inventive corner fitting in that an exchange of intermediate layers, which are surrounded by the locating portions of the fitting elements, will not be necessary, whereby at least one operational step is saved. In fact, other than an assortment of differently sized distancing elements, no other exchange of for example the frame surrounding the fitting elements is required, which served for covering a gap formed between the door element and the fitting elements abutting on both sides there against.

With the intention to avoid repeating the advantages of the inventive method, it is referred to the description of the advantageous embodiment of the inventive corner fitting and it is fully and comprehensively referred to the latter.

BRIEF DESCRIPTION OF THE DRAWINGS

Hereinafter, further measures enhancing the disclosure will be illustrated in more detail in conjunction with the description of preferred embodiments of the disclosure based on the Figures.

In the drawings.

Throughout the different Figures, same parts are always identified by the same reference numerals, and therefore they will be normally only described once.

DETAILED DESCRIPTION OF THE DRAWINGS

Figure 1B:
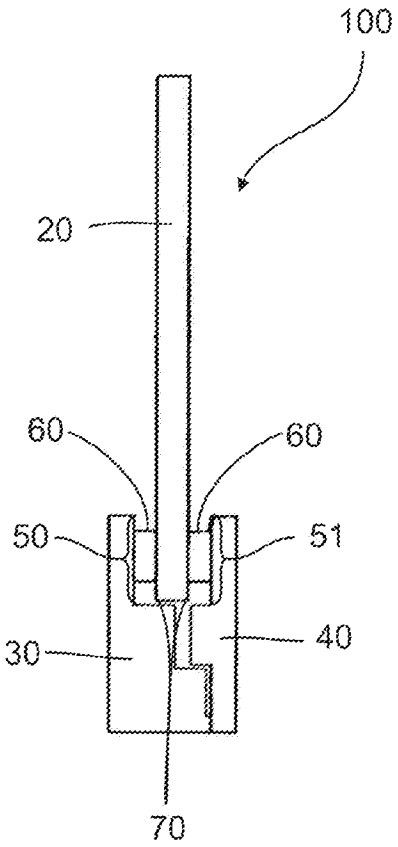
FIG. 1 A and FIG. 1B: show a corner fitting known from the state-of-the-art, which serves for accommodating door elements having different door leaf thicknesses by inserting different intermediate layers.
Figure 1A:
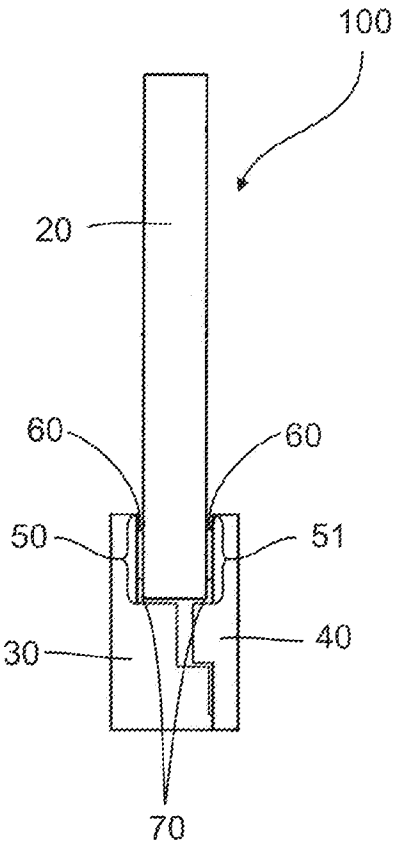

FIGS. 1A and B illustrate a corner fitting 100 known from the state-of-the-art in a frontal view with the part of the corner fitting 100 to be disposed on an axis of rotation. The corner fitting 100 comprises two fitting elements 30 and 40, which engage in each other in the lower part via contours. By means of said contours, the fitting elements 30 and 40 form a reception area, respectively a restraining area 70 for a door element 20. For this purpose, the fitting elements 30 and 40 include respective locating portions 50 and 51, which each abut indirectly via an intermediate layer 60 on both sides of the door element 20. In the frontal view on the corner fitting 100, illustrated in the FIGS. 1A and B, just the part of the locating portions 50 tapering towards the axis of rotation can be seen. As the locating portions 50 and 51 taper in the direction of a reception for the axis of rotation, below the door element, which includes a cutout, the contour thereof following approximately the locating portions 50, a free space is formed in the frontal part of the corner fitting 100, illustrated in FIGS. 1A and B, below the door element 20 for being able to accommodate the corner fitting 100 respectively for being able to dispose it on a center of rotation respectively an axis of rotation.

As shown in FIG. 1A, the corner fitting 100 known from the state-of-the-art is structurally designed for a door element 20 having a relatively thick glass thickness. This means that the thickness of the intermediate layers 60 can be kept as low as possible, so that a cover placed onto the fitting elements 30 and 40, which surrounds the fitting elements 30 and 40, abuts against the surfaces of the door element 20. In the present case, the cover surrounding the fitting elements 30 and 40 is not illustrated. In case it is desired to utilize the corner fitting 100 illustrated in FIG. 1A for disposing a door element 20 on a center of rotation respectively an axis of rotation, and the door element 20 has a smaller glass thickness, the known corner fitting 100 needs to be adapted to the smaller glass thickness of the glass door element by means of intermediate layers 60, wherein the intermediate layers 60 need to be correspondingly thicker to be able to accommodate, respectively to restrain the glass door element as illustrated in FIG. 1B, which has a smaller glass thickness than the door element 20 illustrated in FIG. 1A, in the restraining area between the fitting elements 30 and 40. A cover, respectively a cover element, as the one that would be used in FIG. 1A for covering the fitting elements 30 and 40, would then not abut anymore against the glass door element 20 such that a gap could be visible between the cover and the surfaces of the glass door element and formed on both sides of the door element. In addition, a thicker intermediate layer 60 could result in that clamping, respectively restraining the door element 20 between the fitting elements 30 and 40 in the restraining area 70 would become more unstable, which could in particular affect the longevity of the corner fitting 100. In the extreme case, the material properties of the intermediate layers 60 could change over the time of operational demands on the known corner fitting 100 such that the door element 20 tilts out of the clamping respectively restraining area 70 and thereby damages for example a floor or gets damaged itself. This could be possibly counteracted in that in case of operational demand on the known corner fitting, the connection between the fitting elements 30 and 40 would be readjusted to press for example an intermediate layer 60 that became brittle or softer with a higher pressure to the surfaces of the door element 20 restrained in the restraining area 70. Also even if the corner fitting 100 known from the state-of-the-art would be able to solve the indicated problems, namely for example with a cover element drawn deeper, which would abut against the surfaces of the door element 20 when restraining a narrower glass door element 20, and if the materials of the intermediate layers 60 would be improved insofar that they would keep the material properties over the period of operation of the known corner fitting 100, it is still disadvantageous that with narrower door elements 20, i.e. with door elements 20 having a smaller glass thickness, the construction depth of the corner fitting 100 would increase when inserting thicker intermediate layers 60.

FIGS. 2 to 5 illustrate an inventive corner fitting 1, which solves all the problems of a conventional corner fitting 100

Figure 2:
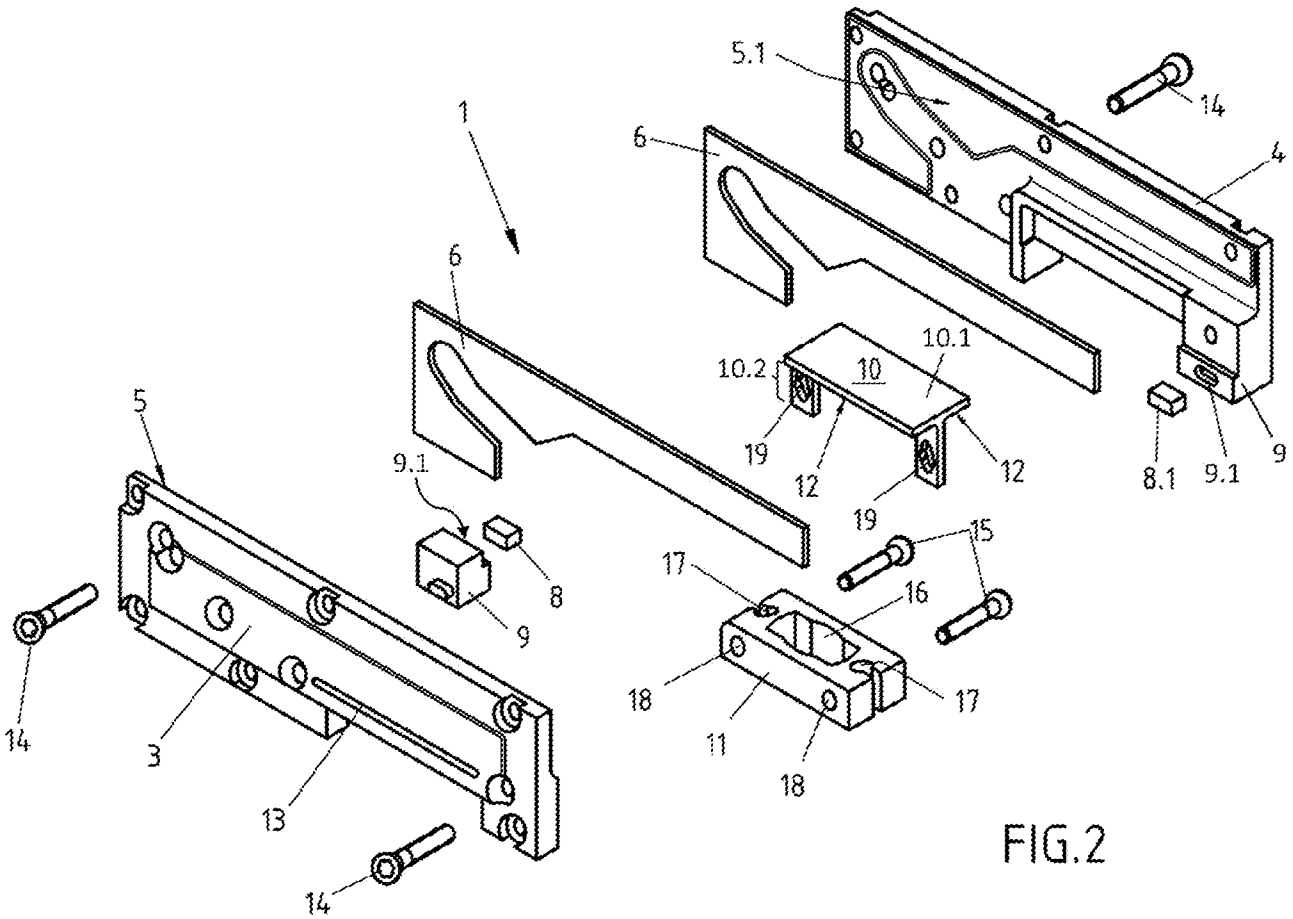
FIG. 2 shows an exploded view of the essential structural components of an inventive corner fitting, which serve for forming a restraining area and for disposing the corner fitting on an axis of rotation, FIG. 3 A and FIG. 3B show the reception of a glass door element with a universal glass cutout in the corner fitting of FIG. 2, wherein the fitting element shown in FIG. 2 on the top right is not illustrated, in a top view from the bottom in A), and in a lateral view in B), FIG. 4 A and FIG. 4B show the inventive corner fitting of FIG. 2 with just one distancing element with a glass door element with Italian glass cutout, wherein the fitting element shown in FIG. 2 on the top right is not illustrated, in A) in a top view from the bottom, and in B) in a lateral view in, and FIG. 5 A and FIG. 5B show the corner fitting of FIG. 2 in a frontal sectional view, wherein in A) a glass door element having a glass thickness of approximately 15 mm is restrained, and in B) a door element having a glass thickness of approximately 8 mm is restrained.

FIG. 2 shows an exploded view of an inventive corner fitting 1 without the frame surrounding the fitting elements 3 and 4 and without a cover element attached to the frame. At the fitting elements 3 and 4, the inventive corner fitting 1 comprises locating portions 5 and 5.1 configured at least sectionwise, which serve for locating a door element 2, which is disposed between the fitting elements 3 and 4 and disposed on an axis of rotation respectively a center of rotation. As the fitting elements 3 and 4 are preferably made from metal, a metal allow or also for example a plastic material metal alloy, the locating portions 5 and 5.1 respectively comprise an intermediate layer 6, which is between the locating portions 5 and 5.1 and the door element 2. As the door element 2 is preferably a glass door element, on the one hand the intermediate layer serves for preventing the contact of metal on glass. On the other hand, the intermediate layers 6 assist the dampening properties of the inventive corner fitting 1, increase the friction quotient between the glass door element and the fitting elements 3 and 4, and also when the elasticity is lower, they serve as screw securing for the attaching means 14, by means of which the fitting elements 3 and 4 are preferably connected to each other. Preferably, the intermediate layers 6 are made from a plastic material or a rubber elastic material for this purpose. Obviously, the intermediate layers 6 could be configured from ferroelastic soft materials or metal elastomer compounds, such as known for example for cylinder heads in the automotive industry. In particular, when utilizing the inventive corner fitting 1 for disposing glass door elements 2, which serve as fire-rated doors, highly durable metal elastomer compounds would be of importance for the intermediate layers 6. One respective mount 9, which serves for disposing, i.e. for inserting exchangeable rigid distancing elements 8 and 8.1, is intended in the lower area of the fitting elements 3 and 4. In the fitting element 4, the mount 9 is a recess in the shape of a pocket hole, which serves for the at least positive accommodation of the distancing element 8.1. The mount 9 illustrated for the fitting element 3 for inserting the rigid distancing element 8 is configured as a separate structural component, which engages, respectively can be inserted for example into a bore, in particular into a pocket hole configured at the fitting element 3. The mount 9 of the fitting element 3, just like the mount 9 of the fitting element 4, has a recess, which serves for inserting, respectively for a positive connection to the distancing element 8. As illustrated in the following FIGS. 3 and 4, depending on the type of glass cutout of the door element 2, the mount 9 inserted into the fitting element 3 can be optionally foregone, which however, does not affect the functioning of the remaining distancing element, in this case the distancing element 8.1, nor does it affect the functioning of the corner fitting 1.

A connecting element 11, which is operatively connected to a holding element 10, serves for supporting the door element 3 on the center of rotation 2 and/or the axis. The holding element 10 includes a head part 10.1 and a connecting part 10.2. In the present case, the connecting element 11 is non-positively and/or positively operatively connected at the connecting part 10.2 to the holding element 10 and together with the connecting element 11 forms the attaching mechanism. The holding element 10 being in operative connection with the connecting element 11 is guided via the head part 10.1 to be movable in a free space 13 configured as a recess in the shape of a groove in the fitting element 3 and the fitting element 4. In this case, the free space 13 is configured in the shape of recess configured as a groove parallel to the longitudinal extension of the fitting elements 3 and 4. The holding element 10 and the connecting element 11, which is in operative connection via the attaching elements 15, are thereby displaceable parallel in the free space 13, i.e. with regard to, i.e. in the longitudinal extension of the fitting elements 3 and 4. As the connecting element 11 with the holding element 10 is displaceable in the opposite direction in relation to a restrained door element 2, the door element 2 can be infinitely variably adjusted to a center of rotation for example in its position in a door frame or a glass door installation. In the event e.g. the center of rotation, respectively the axis of rotation of the door element 2 is located outside the standardized ranges for the usual centers of rotation, namely outside of 55 mm, 65 mm or 70 mm, the door element 2 may be aligned on the center of rotation and/or the axis by displacing the holding element 10 with the connecting element 11, which is operatively connected to the holding element 10. In the present case, the holding element 10 and the connecting element 11 are configured as two interconnected structural components comprising the attaching mechanism, which presently is incorporated into both structural components, namely the holding element 10 and the connecting element 11. For transferring the attaching mechanism form the released condition, in which the holding element 10 is supported to be movable in the longitudinal extension of the fitting elements 3 and 4 in the free space 13 configured as a recess, into the fixing condition, the attaching elements 15, which connect the holding element 10 via the connecting part to the connecting element 11, are screwed into the through-holes 18. When screwing the attaching elements 15 into the connecting part 10.2 of the holding element 10, the head part 10.1 of the holding element gets clamped at least sectionwise non-positively in the free space 13, configured as a recess in the form of a groove or a slot on both sides of the fitting elements 3 and 4. Thus, in the fixing condition of the attaching mechanism, the displaceability of the holding element 10 and of the connecting element 11 operatively connected to the holding element 10 is disabled, respectively the holding element 10 is immobilized at the fitting elements 3 and 4.

As already described, attaching elements 15, which pass through through-holes 18 in the shape of bores configured in the connecting element 11, serve for the non-positive and/or positive connection between the connecting element 11 and the holding element 10. Advantageously, the through-holes 18 or bores are embodied in the shape of internal thread bores. Advantageously, the attaching elements 15 configured in the shape of screws engage in the through-holes 18 configured as internal thread bores. For disposing the door element 2 on a center of rotation and/or an axis, a reception 16 is configured almost in the center of the connecting element 11. Advantageously in this case, the reception 16 is adaptable to the center of rotation and/or the axis, for example by means of different adapter inserts.

As, in the present exemplary embodiment, the connecting element 11 is a single component of the corner fitting 1, obviously the latter may obviously be variably connected to the holding element 8 also with differently sized receptions 16. For connecting the holding element 10 to the connecting element 11, the connecting element 11 has apertures 17 configured in the area of the through-holes 18, which serve for accommodating the connecting part 10.2 of the holding element 10, which in the present case is configured as a tappet. The tappets have respectively one bore 19, through which the attaching elements 15 engage, which are guided in the through-holes 18 and thereby non-positively and/or positively connect the connecting element 11 to the holding element 10. The head part 10.1 of the holding element disposed orthogonally to the connecting part 10.2 is guided, respectively retained in the free space 13 configured as a recess in the fitting elements 3 and 4.

For this purpose, the head part 10.1 has resting portions 12, which reach abutment at locating surfaces configured in the free space 13. By tightening the attaching elements 15 and by abutment of the resting portions 12 of the head part 10.1 of the holding element 10 against the locating surfaces of the free space 13 of the fitting elements 3 and 4, an increased static friction is generated between the resting portions 12 of the head part 10.1 of the holding element 10 and the locating surfaces of the free space 13, and thus results in a non-positive connection between the holding element 10 and the fitting elements 3 and 4. The non-positive connection between the holding element 10 and the free space 13 of the fitting elements 3 and 4 may be even increased in that the resting portions 12 of the head part 10.1 of the holding element 10 include a ribbing on the surface, for example a diamond-shaped ribbing, which engages in a ribbing configured in the locating surfaces of the free space 13 such that in addition to the non-positive connection also a positive connection is created between the holding element 10 and the fitting elements 3 and 4. For increasing a clamping, i.e. the friction effect between the holding element, in particular between the engaging, respectively resting portion 12 and the free space 13 configured as a recess, advantageously, the engaging, respectively resting portion 12 includes a ribbing. Obviously, the clamping of a holding element 10 configured as a clamping plate, may also just be effected by a non-positive connection.

Figure 3A:
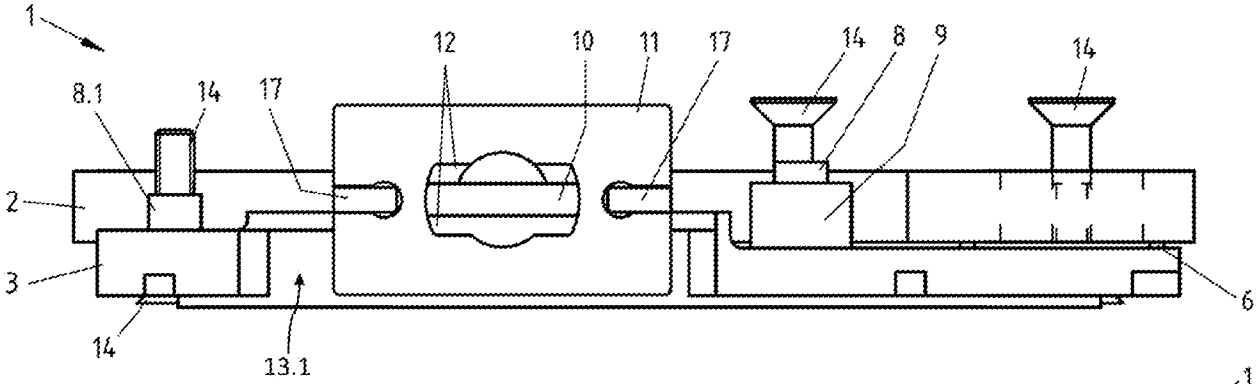
Figure 3B:
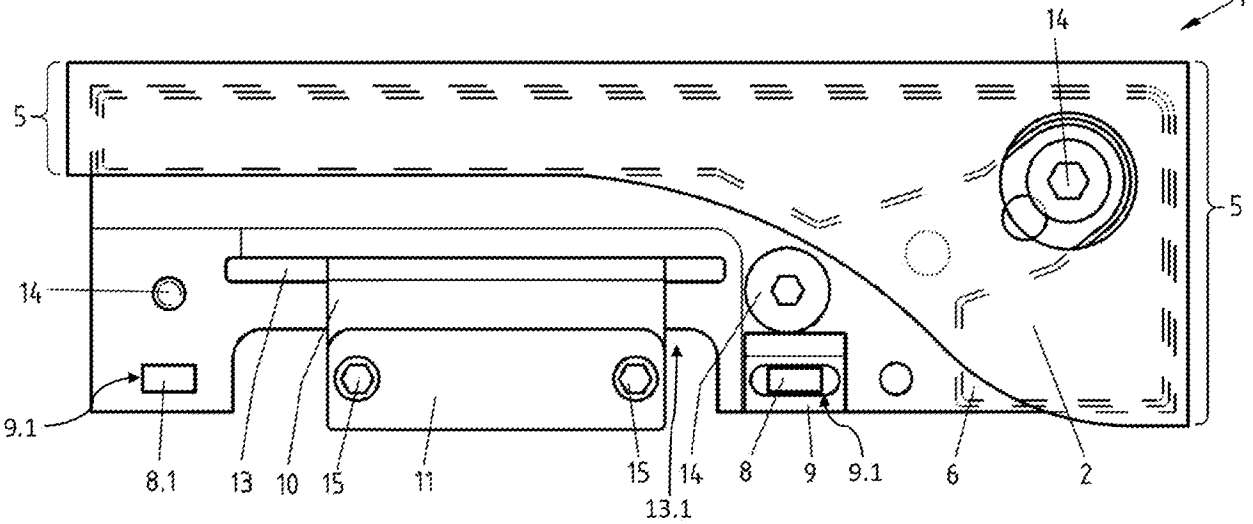

The FIGS. 3 A and B show the corner fitting 1 illustrated in FIG. 2 without the fitting element 4, in A in a top view from the bottom and in B in a lateral view. Also a frame surrounding the fitting element 3, and a cover, respectively a cover element fitted onto said frame are not illustrated in FIGS. 3 A and B for the sake of clarity. As illustrated in the FIGS. 3 A and B, the distancing elements 8 and 8.1 are disposed parallel to each other outside the locating portion 5 almost on the height of a lower recess 13.1 in the bottom area 13.2 of a free space formed between the fitting elements 3 and 4. In this case, the lower recess 13.1 serves for the displaceability of the connecting element 11 with the holding element 10 parallel to the longitudinal extension of the fitting elements 3 and 4. The locating portion 5 is adapted to the glass cutout of the door element 2 restrained in the corner fitting 1. The locating portion 5 just as the intermediate layer 6, which is surrounded by the locating portion 5, in the right part, as illustrated in FIG. 3A and FIG. 3B, extend over the entire height of the fitting element 3 and taper to the left following the glass cutout, such that below the glass cutout, the free space is created for accommodating the holding element 10 and the connecting element 11, which is operatively connected to the holding element 10, as well as for disposing the distancing elements 8 and 8.1 between the fitting elements 3 and 4. In the present caste, the glass cutout configured in the door element 2 is a glass cutout "universal". As the size of the rigid distancing elements 8 and 8.1 is adaptable to the glass thickness of the door element 2, i.e. the distancing elements 8 and 8.1 are exchangeable, all door elements with a glass cutout "universal" having different glass thicknesses can be restrained with the inventive corner fitting 1 and be disposed for example on an axis of rotation.

Figure 4A:
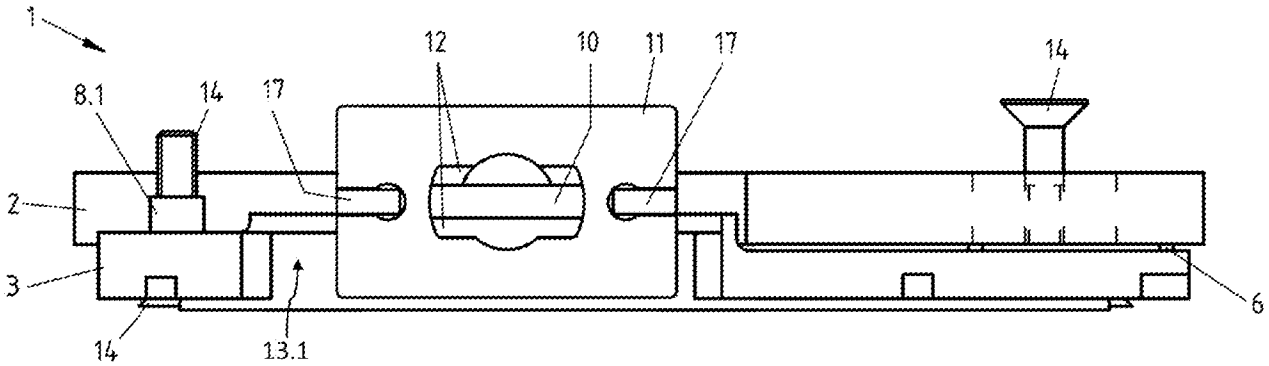
Figure 4B:
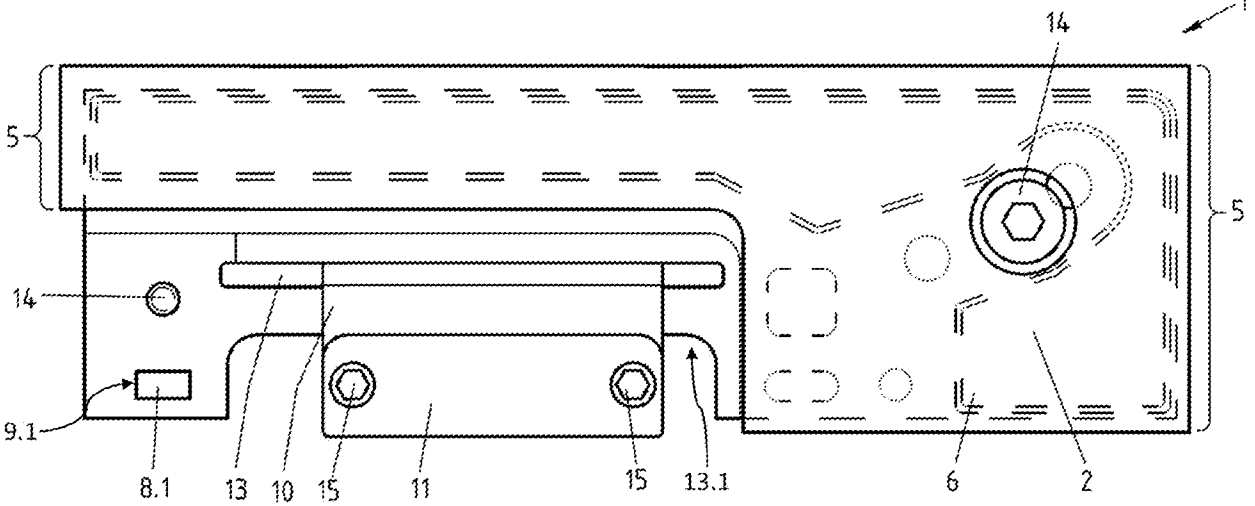

FIGS. 4 A and B likewise show the corner fitting 1 of FIGS. 2 and 3, wherein however here a door element 2 having an Italian glass cutout is restrained between the fitting elements 3 and 4. Presently, for the purpose of illustration, just the fitting element 3 is illustrated. In this case, a top view from the bottom is shown in FIG. 4 A, and a lateral view of the inventive corner fitting 1 is shown in FIG. 4 B. As can be seen in particular in FIG. 4B, the Italian glass cutout superimposes the position for the second distancing element 8. Insofar, here just the distancing element 8.1, which is inserted into the aperture 9 of the fitting element 3, serves as a counter bearing to the locating portion 5 and 5.1 and the door element 2 restrained between the fitting elements 3 and 4. As the size of the distancing element 8.1 is adaptable to the glass thickness of the door element 2, i.e. the distancing element 8.1 is exchangeable, all door elements with an Italian glass cutout having different glass thicknesses can be restrained with the inventive corner fitting 1 and be disposed for example on an axis of rotation.

Figure 5B:
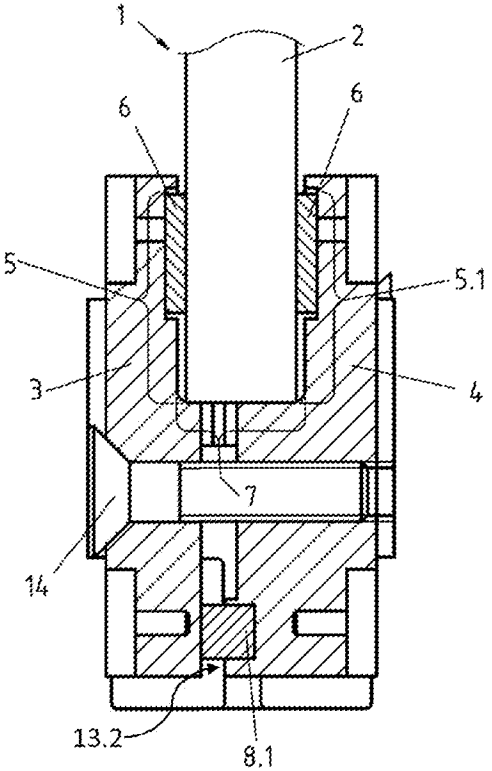
Figure 5A:
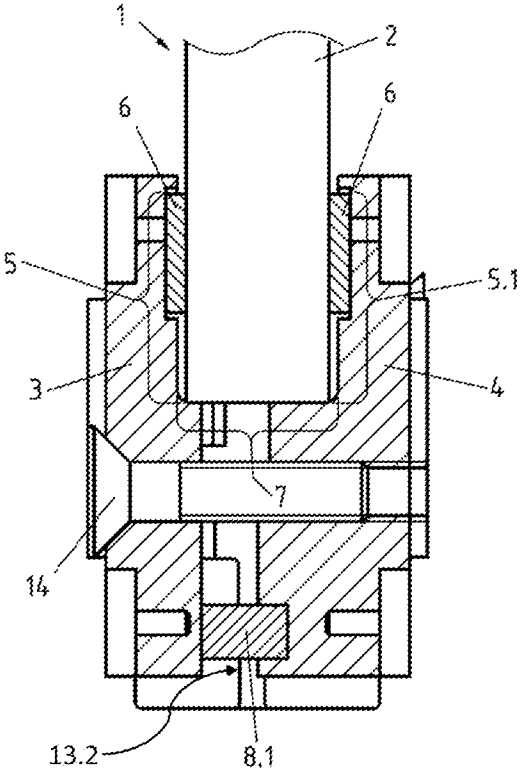

The advantageous functioning of the inventive corner fitting 1, namely in particular the consistent construction depth thereof with the same intermediate layers 6 is represented in an impressive way by illustrating the inventive corner fitting in a frontal sectional view in the FIGS. 5 A and B.

In FIG. 5 A, the door element 2 is clamped between the fitting elements 3 and 4, which compared to the door element 2 of FIG. 5 B has a glass thickness which is almost twice as thick. By way of example the door element 2 has a glass thickness of 15 mm in FIG. 5 A. By way of example the door element 2 in FIG. 5 B has a glass thickness of just 8 mm. As can be seen in both FIGS. 5 A and B, the distances between the fitting elements 3 and 4 and the door element 2, namely seen towards the surfaces thereof, are identical, because the intermediate layers 6 remain the same, namely when comparing the FIGS. 5 A and 5 B, they have the same material thickness, even though the glass thickness of the restrained door element is almost half as thick. Thus, independently of the glass thickness of the accommodated door element 2 and independently of the size of the restraining area 7, the construction depth of the inventive corner fitting 1 can remain constant. As pressure is built-up in the upper area of the corner fitting 1, namely between the fitting elements 3 and 4 on both sides of the door element 2 by tightening the attaching means 14, wherein the force, applied for the pressure approximately in the center of the leaf thickness of the door element 2, i.e. almost in the center of the restraining area 7 in the resultant, is equal to zero, in the lower area of the corner fitting 1, namely between the fitting elements 3 and 4 outside the restraining area 7, a similar ratio of forces needs to be generated between the fitting elements 3 and 4. This is realized according to the disclosure by disposing the distancing element 8.1, which extends between the fitting elements 3 and 4 outside the restraining area 7 in the free space formed between the fitting elements 3 and 4 in the bottom area 13.2 between the fitting elements 3 and 4 and props up against the fitting elements 3 and 4. The size of the free space in the bottom area 13.2 between the fitting elements 3 and 4 in FIG. 5 B is so small that the fitting elements 3 and 4 almost contact each other. In contrast thereto, the free space in the bottom area 13.2 between the fitting elements 3 and 4 as illustrated in FIG. 5 A, is considerably larger. In this case, the size of the distancing element 8.1 is determined by the glass thickness of the door element 2 and is to be adapted such that the distancing element 8.1 extends over the free space between the fitting elements 3 and 4. It can be seen in FIG. 5 A that a larger distancing element 8.1 is inserted between the fitting elements 3 and 4 than the one in FIG. 5 B. In this case, the difference of the glass thickness of FIG. 5 A to the glass thickness of FIG. 5 B determines the difference in size between the distancing element 8.1 of FIG. 5 A and the distancing element 8.1 of FIG. 5 B.

The invention claimed is:

1. A corner fitting for a door element including a first fitting element and a second fitting element, which each include, at least sectionwise, a locating portion, which comprises an intermediate layer able to contact with the door element, and the fitting elements delimit a restraining area, wherein a holding element is interconnected with a connecting element, which serves for supporting the door element on a center of rotation and/or an axis, wherein at least one exchangeable rigid distancing element is disposed between the first and second fitting elements and separate from the locating portions, wherein the distancing element forms a counter-bearing to the locating portions and the door element which can be restrained in the restraining area, wherein a free space in the shape of a recess extends along the longitudinal extension of the fitting elements, and the holding element is supported with a head part in the free space to be movable, wherein, in the fixing condition, the holding element with a resting portion, which is located at the head part, abuts against the free space.

2. The corner fitting according to claim 1, wherein the first and second fitting elements each include a mount, at which the distancing element is disposed and which is provided separate from the locating portions.

3. The corner fitting according claim 2, wherein the mount includes a reception in which the distancing element extends.

4. The corner fitting according to claim 2, wherein the first and second fitting elements are embodied with a lower recess, in which the connecting element is displaceable, wherein a bottom area forms as a free space between the first and second fitting elements, and the distancing element is located at approximately the same height as that of the lower recess.

5. The corner fitting according to claim 4, wherein two distancing elements are provided, wherein the lower recess for the connecting element is located between the distancing elements.

6. The corner fitting according to claim 2, wherein the mount forms a common structural component with at least one of the first and second fitting elements.

7. The corner fitting according to claim 1, wherein the distancing element is exchangeable with a distancing element having a different material thickness to accommodate a thickness of the door element, without the need to exchange the intermediate layer.

8. The corner fitting according to claim 1, wherein an attaching mechanism is incorporated at the holding element as well as at the connecting element, which mechanism is transferable between a released condition and a fixing condition, wherein, in the released condition, the holding element is displaceable at the first and second fitting elements, and in the fixing condition it is connected to at least one of the first and second fitting elements.

9. The corner fitting according to claim 8, wherein the attaching mechanism is configured such that in the released condition, a static friction is effective between the holding element and the free space, which is considerably lower than the static friction, that is effective in the fixing condition between the holding element and the free space.

10. The corner fitting according to claim 8, wherein in the fixing condition, a clamping is effective between the holding element and the free space, wherein the clamping prevents a movement of the holding element in relation to the fitting elements.

11. The corner fitting according to claim 8, wherein the attaching mechanism is configured such that during the transfer from the fixing condition into the released condition and vice versa, the holding element performs a stroke movement within the free space.

12. The corner fitting according to claim 8, wherein a transfer from the fixing condition into the released condition and vice versa can be performed via the attaching mechanism, which is disposed at the connecting element and is accessible for the user from the outside of the corner fitting.

13. The corner fitting according to claim 1, wherein the holding element includes a connecting part, to which the connecting element is attached, via the attaching element, wherein the head part and the connecting part are aligned vertically.

14. A method for adjusting a corner fitting for a door element for accommodating different material thicknesses of the door element in the corner fitting, including a first fitting element and a second fitting element, which, each at least sectionwise, include a locating portion, which comprises an intermediate layer able to contact the door element, and the first and second fitting elements delimit a restraining area, wherein a holding element is interconnected with a connecting element, which serves for supporting the door element on a center of rotation and/or an axis, at least one distancing element is disposed on a mount between the first and second fitting elements and separate from the locating portions, wherein the distancing element forms a counter-bearing to the locating portions and the door element, which can be restrained in the restraining area, wherein the method includes the following steps are intended:

1) dismounting the first and second fitting elements, 2) removing the at least one distancing element from the mount, 3) inserting at least one new distancing element having a different material thickness into the mount, 4) mounting the first and second fitting elements.

* * * * *